US005988463A

United States Patent [19]

DiCarlo et al.

[11] Patent Number: 5,988,463

[45] Date of Patent: Nov. 23, 1999

[54] NEEDLE THREADER

[76] Inventors: William L. DiCarlo, 3 Station Rd., Madison, N.J. 07940; James P. McCarthy, 2576 Valley View Dr., Bangor, Pa. 18013

[21] Appl. No.: 09/144,619

[22] Filed: Aug. 31, 1998

[51] Int. Cl.[6] ..... D05B 87/00

[52] U.S. Cl. ..... 223/99

[58] Field of Search ..... 223/99, 101, 102, 223/105; 112/222

[56] References Cited

U.S. PATENT DOCUMENTS

| | | | |
|---|---|---|---|
| 2,042,403 | 5/1936 | Hrivnak | 233/99 |
| 2,411,118 | 11/1946 | Schuster | 223/99 |
| 3,250,447 | 5/1966 | Larew | 223/99 |
| 4,090,649 | 5/1978 | Cichinski | 223/99 |
| 4,667,860 | 5/1987 | Feuerman | 223/99 |
| 4,972,979 | 11/1990 | Gordon | 223/99 |

*Primary Examiner*—Bibhu Mohanty
*Attorney, Agent, or Firm*—Alfred E. Miller

[57] ABSTRACT

A needle threader for yarn or other bulky materials that is used in needlework having a projecting loop provided with a substantial planar surface to accommodate the strands of the yarn and thereby reducing frictional resistance as the yarn is passed through the eye of the needle. The needle threader is provided with a cutter for the yarn on the same handle utilized by the threader.

10 Claims, 4 Drawing Sheets

NEEDLE THREADER

FIELD OF THE INVENTION

This invention relates to needle threaders and more particularly to needle threaders for threading tapestry and chenille needles using yarn, embroidery floss, ribbon, pearl cotton, decorative thread or other material of the kind employed in counted cross stitch, needlepoint, hardanger, ribbon embroidery and other needlework techniques.

BACKGROUND OF THE INVENTION

Threading a needle requires considerable manual dexterity and the prior art reveals many threaders developed to make it easier. Tapestry and chenille needles as well as other needles suited for yarns can be especially tricky to thread because unconstrained strands of yarn tend to catch on the edges of the needle eye impeding passage of the yarn through the eye of the needle. Inasmuch as yarn is generally thick and bulky, it often bunches up when pushed or pulled into the needle eye augmenting the frictional forces which resist free passage of the yarn.

Some early needle threaders revealed by the prior art are hook-shaped. The thread is placed upon a hook and pushed through the eye. Alternatively, the hooked portion is first placed through the eye and then the thread is placed within the hook. As the hook is withdrawn, it pulls the thread back through the eye. A variation of this hook shape is exemplified by U.S. Pat. No. 698,855 to Printz which shows an "open" format, L-shaped threader. An important drawback of this device is that it does not hold the thread as securely as the "closed" loop threader shown in U.S. Pat. No. 1,144,504 to Schneider, nor is Printz directed to the difficult frictional problems encountered when threading yarns or other bulky threads.

Schneider describes a needle threader employing a resilient wire loop. The loop is narrowly pointed at one end and broadens convexly toward the middle. The narrow point can be used to find the eye of a small needle whereas the broader portion is used to catch the thread. The wire loop is resilient enough to be compressed enabling it to fit through an eye smaller than its uncompressed dimension. However this type of needle threader is unsuitable for yarns or bulky material because the thin wire loop tends to distort or break when material thicker than ordinary sewing thread is forced through the needle eye.

U.S. Pat. No. 3,840,160 to Pearce specifically addresses the breakage problem associated with flexible wire loop needle threaders by replacing the thin wire loop with sheet material, preferably aluminum. This change permits the thickness of the loop material measured along the plane of the loop to be considerably greater than the wire used in conventional wire loop threaders. Consequently, the Pearce device can be made stronger than most wire loop threaders enabling it to thread needles for yarn and other bulky materials. An inherent difficulty in the use of a broader or thicker loop is that fewer yarns can be accommodated with any one-sized threader because the loop opening is smaller than the loop opening in a wire loop threader of the same outside diameter.

Another limitation is that Pearce depicts threaders that have a round or "arcuate" opening for accepting the yarn. Likewise, a patent to Muriel A. David, U.S. Pat. No. 3,838,801, for a yarn threading device shows threaders having "substantially circular" openings for accepting yarn. The David patent teaches that the circular openings in a threader can be appreciably larger than the yarn thereby permitting the yarn to "fan out" lessening mechanical resistance to movement through the eye of a needle. While it is evident that a very large opening in a threader will permit a larger "fan out", a round or circular opening in a yarn threader is not necessarily the optimum shape to spread the yarn. Indeed an important aspect of the present invention is that a rectangular opening is more desirable for passage of yarns than a round opening in a yarn threader.

A further limitation of sheet metal threaders is that the threader opening is difficult to deburr effectively. Burrs or sharp edges within the threader opening can cause yarn fibers to break especially when subjected to the pressures caused by bunching or piling of fibers when entering the needle eye.

BRIEF SUMMARY OF THE INVENTION

The threader of the instant invention is constructed with a wire loop having a generally rectangular shape on one end which can be inserted through the eye of a needle and is particularly adapted for needles designed to accept yarns or other bulky materials. The word "yarn" in this context should be understood broadly to include any thread, or bulky or fuzzy or multi-strand material used in the execution of needlework techniques.

The wire loop of the present invention is comprised of relatively heavy gauge wire fixedly attached at one end to a flat handle. The wire forming the loop has at least one rounded interior edge to insure that the yarn contained therein will pass smoothly and not snag. The handle is sufficiently thick along its peripheral edges to make it easy for the user to pick it up from a table surface. In one form of the invention, the handle contains a cutting blade embedded within a recess in the peripheral edge of the handle. For safety reasons the cutting blade is located somewhat below the periphery leaving it exposed to the outside edge and available to cut yarn brought within the recess. The handle may also contain a separate hole for use with a lanyard so that the threader can be kept within easy reach. Another feature of the present invention is that it will readily accept printing on the handle for purposes of advertising and product identification.

Accordingly, a main object of this invention is to provide a threader which will improve the ease with which needles for yarns and other bulky materials can be threaded by reducing frictional resistance as the yarn is passed through the eye of the needle.

Another object is to provide a needle threader for yarn having a substantially rectangular-shaped opening made from wire which preserves the size advantages of wire loop needle threaders.

A further object is to provide a needle threader made from wire having at least one rounded interior edge to lessen frictional contact with the product to be threaded.

Another object of the present invention is to provide a needle threader with a cutter for yarn contained within the same handle used by the threader.

Yet another object of the invention is to provide a needle threader for yarn which has a handle surrounding a hole for accepting a lanyard to increase ready availability of the threader to the user.

Another object of the invention is to provide a needle threader with a printable surface to accept advertising and product identification.

And yet a further object of the present invention is to provide a method of threading a needle for yarns which is at once efficient and relatively easy to accomplish.

BRIEF DESCRIPTION OF THE DRAWINGS

These objects together with other objects and advantages of the invention will become clear with reference to the following detailed description supplementally illustrated by the accompanying drawings, in which.

DETAILED DESCRIPTION OF THE INVENTION

Figure 1:
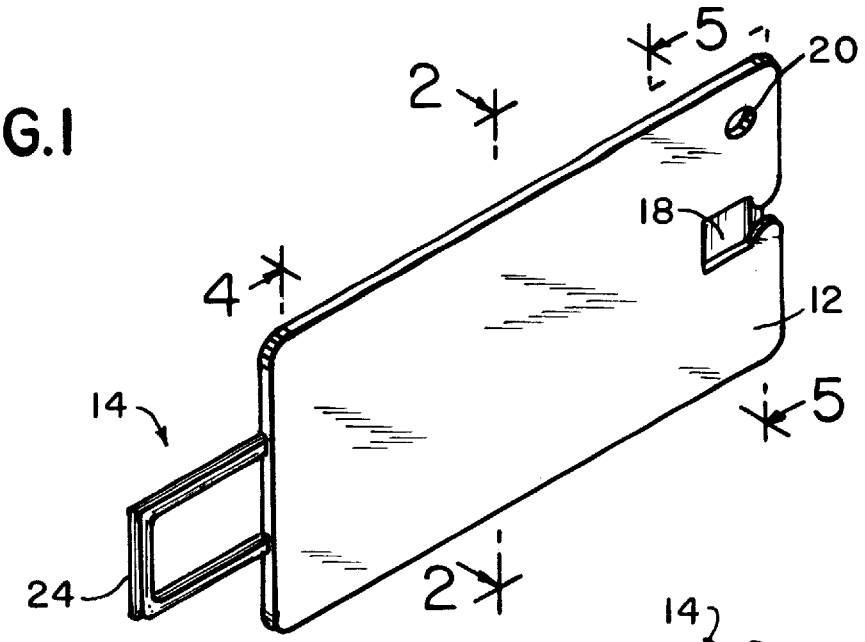
FIG. 1 is a perspective view of a needle threader constructed in accordance with the present invention.

Referring now more specifically to the drawings and to the form of the invention shown in FIGS. 1–10, the needle threader comprises a handle 12 and wire loop which is referred to generally by the reference numeral 14 fixedly attached at one end to the handle. The handle 12 and wire loop 14 are co-planar. The linear and substantially perpendicular integral wire elements 24 form a rectangular wire loop 14 as seen in FIG. 1. The loop 14 extends outward from the handle 12 leaving it free to pass into and through the eye of a needle 30.

The handle 12 is made from a semi-rigid material such as polystyrene or other suitable plastic and, in this embodiment, has a generally rectangular shape extending approximately 1½" (38 mm) in length by ¾" (19 mm)in width and 0.045" (1.14 mm) in height. The wire loop 14 is fabricated from round stainless steel wire. This material has been selected both for its strength and for its desirable non-corroding characteristics. Round wire of 0.012" (0.30 mm) diameter is mechanically formed into a loop having at least one rectangularly shaped end.

Figure 2:
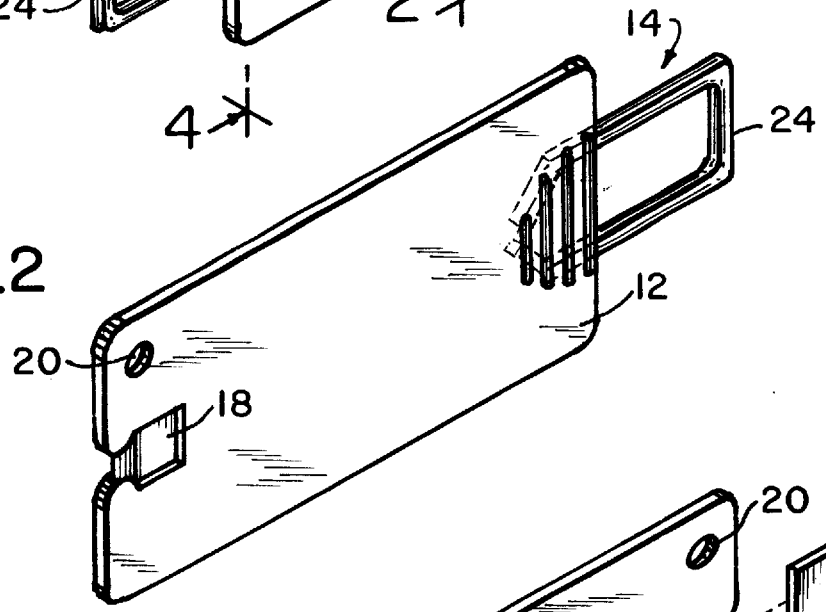
FIG. 2 is a perspective view of the other side of the threader of FIG. 1 shown in reverse.
Figure 3:
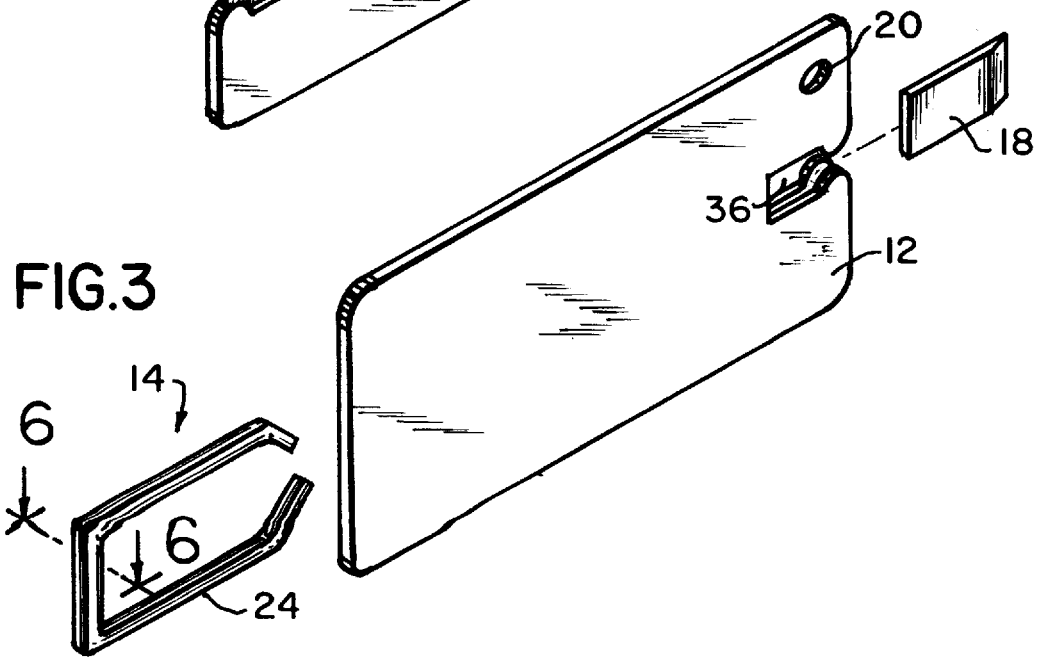
FIG. 3 is a perspective view of the threader in FIG. 1 showing components of the threader separated from the handle portion.
Figure 4:
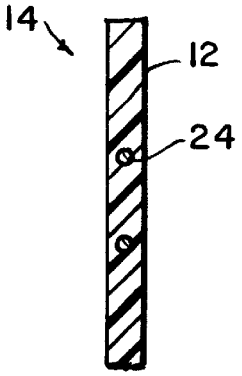
FIG. 4 is a side section taken along the lines 4—4 of FIG. 1.
Figure 5:
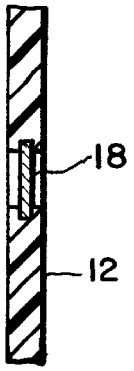
FIG. 5 is a side section taken along the lines 5—5 of FIG. 1.

With specific reference to FIG. 2 of the drawings, the end of the wire loop opposite the exposed rectangular end 24 is mechanically embedded in handle 12. Ths is accomplished by heating the wire above the melting point of the plastic and pressing it into the handle 12 causing the heated plastic to flow around the wire. In this manner the end of the wire loop is permanently attached to the plastic handle.

To assure adequate clearance within the eyes of the widest range of tapestry and chenille needles, the exposed portion of the wire comprising the wire loop is flattened by mechanical deformation until it measures typically 0.005" (0.13 mm) in height and 0.020" (0.51 mm) in width.

Figure 6:
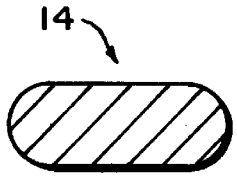
FIG. 6 is a cross-section of the wire taken along the lines 6—6 of FIG. 3.
Figure 7:
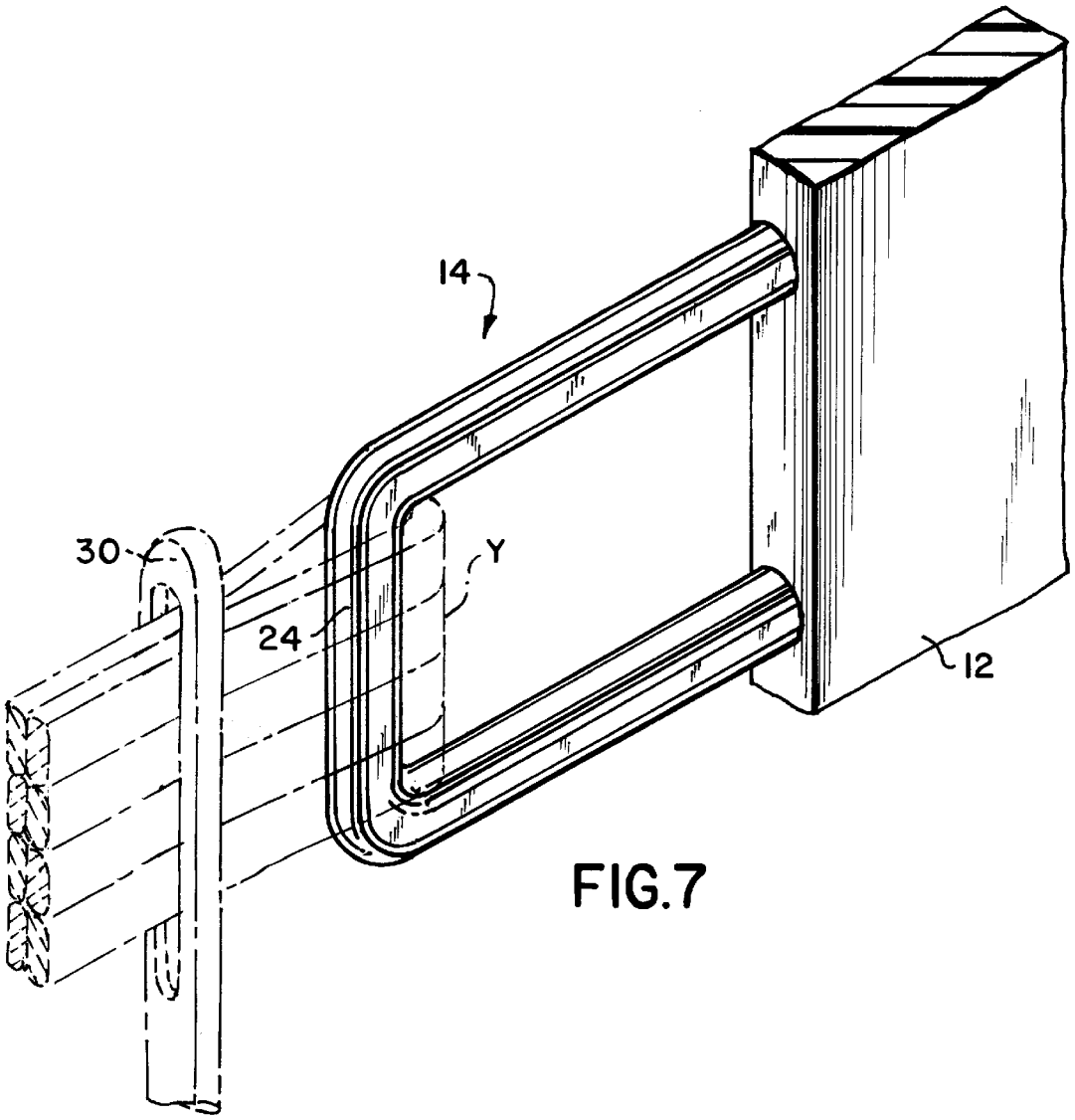
FIG. 7 is a perspective view of the wire loop of the invention with the yarn in place.

With reference to the drawings, and specifically FIGS. 6 and 7, the round edges of the wire are preserved assuring that the wire loop will remain burr-free. Needle threaders made from sheet material, and especially threaders made from sheet metal, are very difficult to deburr and are therefore more likely to cause damage to yarn fibers in the threading process.

The threader handle 12 contains a cutting blade 18 for yarn located opposite the end 24 used for threading. The cutting blade 18 is located in a pocket 36 formed within the handle 12. The pocket is centered around the long axis of the handle and centrally contained within planes defining the outer surfaces of the handle. The blade 18 is retained within the pocket 36 in the same manner as the aforementioned wire loop by heating the blade above the melting point of the plastic and allowing the heated plastic to flow completely around the edges of the blade not required for cutting yarn.

The handle 12 also contains a hang-hole 20 to accept a lanyard (not shown) so that the threader can be hung around a person's neck or attached to a needlework project.

The material from which it is made and the shape of handle 12 were chosen to readily accept printing by conventional means for product identification and for the display of promotional advertising. Earlier threaders often have handles made of metal which require more costly stamping or embossing. Other prior art threaders with nonmetallic handles were typically not flat and therefore not as easily imprinted as the threader of the present invention.

The eyes of tapestry and chenille needles as well as other needles used most often with yarn are elliptical or oval. As such, the eye has a long axis aligned with the body of the needle.

Figure 8:
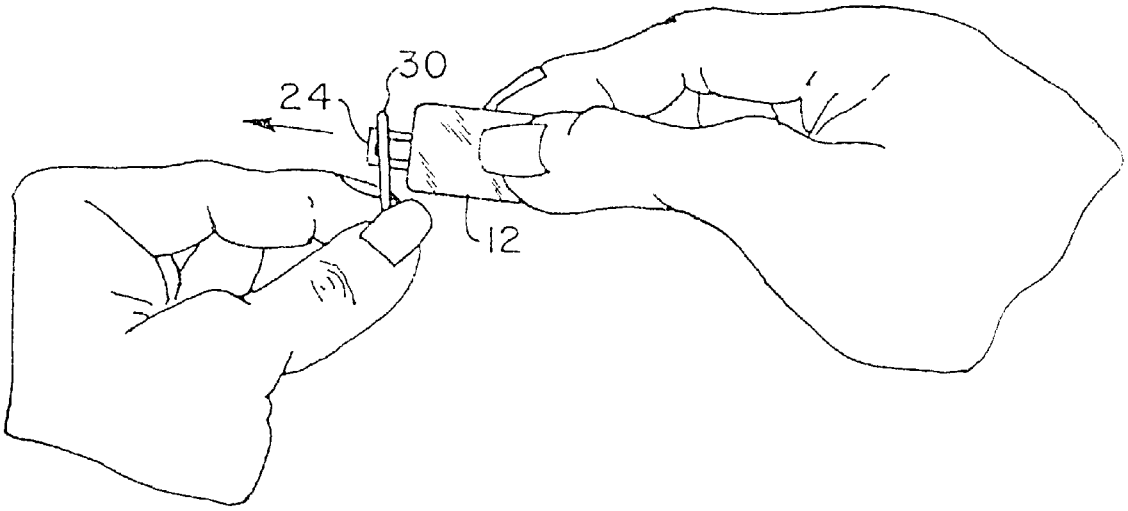
FIG. 8 is an illustration of the first step in the preferred method of using the invention.
Figure 9:
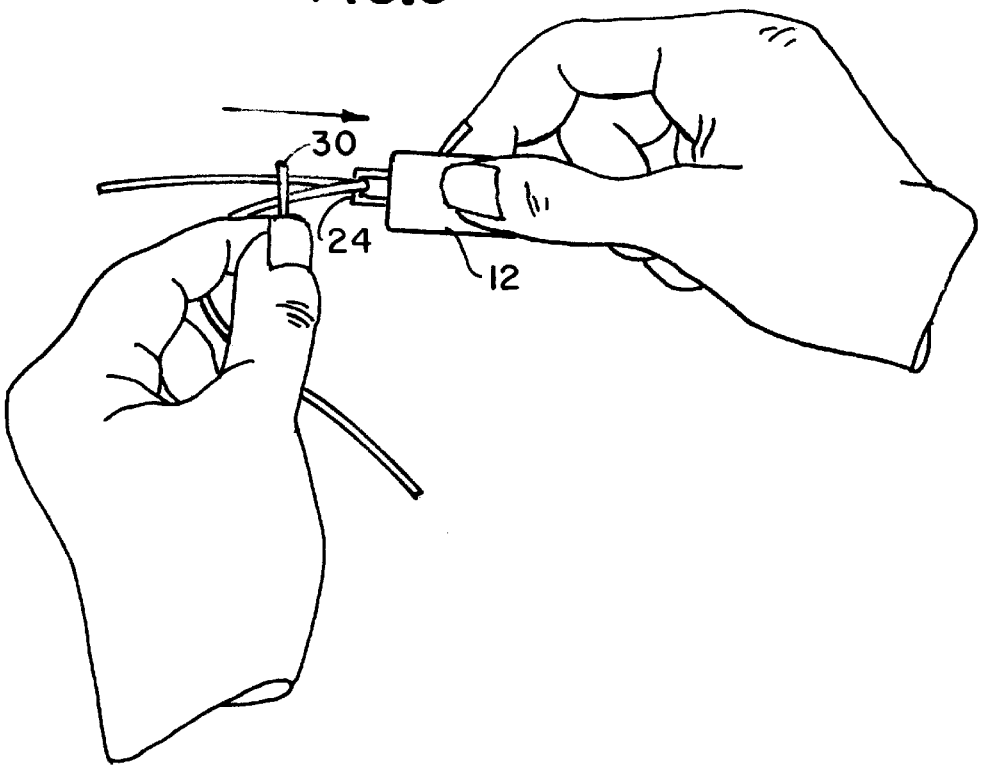
FIG. 9 is an illustration of the withdrawal of the needle threader with the yarn in a step subsequent to FIG. 8.

In actual use, and with particular reference to FIGS. 8 and 9, the rectangular loop 14 on one end of the threader 12 is inserted into the eye of a tapestry or chenille needle 30. The rectangular loop 14 protrudes beyond the eye of the needle and the end of a length of yarn Y is passed therethrough. Then the loop containing the yarn, as shown in FIG. 7, is pulled back through the eye causing the yarn fibers to spread out along the long axis of the eye. The yarn conforms to the long axis easily because the side of the rectangular wire loop is linear. The circular or arcuate shapes of prior art threader loops will not permit as wide a spread of fibers for yarns contained within their respective openings as a threader with a rectangular wire loop of similar outside dimensions. Consequently, threaders with curved or rounded loops or containment areas offer more mechanical resistance to the yarn because the fibers have a greater tendency to pile up as they are pulled through the eye. In addition, the curved or round openings in yarn threaders made from sheet material and sheet metal in particular are very difficult to deburr. Therefore, yarn fibers are more likely to break in response to pressure created by bunching and piling within the curved openings in those threaders.

Figure 10:
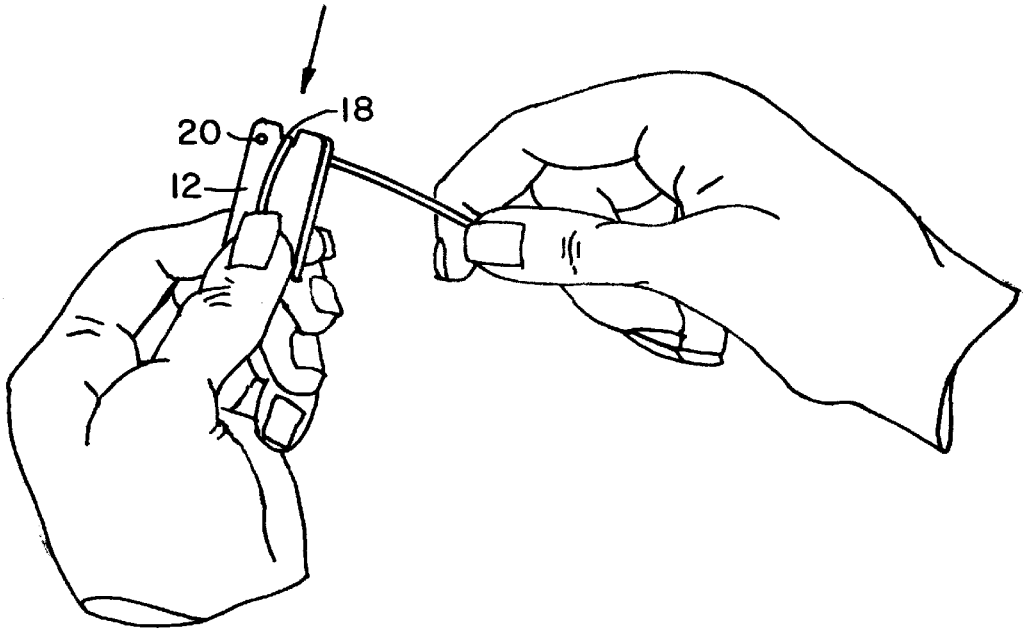
FIG. 10 shows a method of cutting yarn using the present invention.

FIG. 10 of the drawings is an illustration of a method of cutting yarn using the present invention by bringing the yarn into recess 36 located in the periphery of handle 12 of the needle threader 14. Cutting is accomplished by pulling the yarn down manually on the cutting blade 18 with gradually increasing force until the yarn is parted.

It will be apparent that while the invention has been described and shown in a preferred form, changes may be made in the structures shown without departing from the scope of the invention as sought to be defined in the following claims:

We claim:

1. A needle threader for yarn comprising a handle having a loop fixedly attached at one end thereof, said loop having a rectangular end projecting outwards from the handle, said rectangular end comprised of substantially perpendicular linear elements of which only one element is distant from the handle, the width of said loop being small enough to pass through the eye of the needle to be threaded, said loop capable of accepting the yarn to be used therein whereby the fibers of the yarn urged into the eye of the needle will spread out linearly along the axis to the needle eye.

2. The threader of claim 1 in which the loop is comprised of wire.

3. The threader of claim 1 in which the portion of the loop contacting the yarn has at least one rounded interior edge.

4. The threader of claim 1 further comprising a hole in said handle for acceptance of a lanyard.

5. The threader of claim 1 in which the handle has at least one surface comprised of readily printable material.

6. A needle threader for yarn comprising a handle having a loop fixedly attached at one end thereof, said loop having a rectangular end projecting outwards from the handle, the width of said loop being small enough to pass through the eye of the needle to be threaded, said loop capable of accepting the yarn to be used therein whereby the yarn urged into the eye of the needle will spread out linearly along the axis of the needle eye, said threader handle having a cutout portion in a periphery of said handle forming a recess remote from said threader loop, and a cutting blade located in said recess.

7. The threader of claim 6 in which the loop is comprised of wire.

8. The threader of claim 6 in which the portion of the loop contacting the yarn has at least one rounded interior edge.

9. The threader of claim 6 in which the handle is provided with a hole for acceptance of a lanyard.

10. The threader of claim 6 in which the handle has at least one surface comprised of readily printable material.

* * * * *